US010262646B2

(12) United States Patent
Rampley et al.

(10) Patent No.: US 10,262,646 B2
(45) Date of Patent: Apr. 16, 2019

(54) MULTI-SOURCE SWITCHED SEQUENCE OSCILLATOR WAVEFORM COMPOSITING SYSTEM

(71) Applicant: Media Overkill, LLC, Seattle, WA (US)

(72) Inventors: Robert Rampley, Spokane, WA (US); Taiho Yamada, Woodland Hills, CA (US)

(73) Assignee: Media Overkill, LLC, Seattle, WA (US)

( * ) Notice: Subject to any disclaimer, the term of this patent is extended or adjusted under 35 U.S.C. 154(b) by 0 days.

(21) Appl. No.: 15/866,405

(22) Filed: Jan. 9, 2018

(65) Prior Publication Data

US 2018/0197519 A1 Jul. 12, 2018

Related U.S. Application Data

(60) Provisional application No. 62/444,270, filed on Jan. 9, 2017.

(51) Int. Cl.

| | |
|---|---|
| ***G10H 1/06*** | (2006.01) |
| ***G10H 7/00*** | (2006.01) |
| ***G10H 1/00*** | (2006.01) |
| ***G10H 1/08*** | (2006.01) |
| ***G10H 5/12*** | (2006.01) |

(52) U.S. Cl.

CPC ..... *G10H 7/002* (2013.01); *G10H 1/0066* (2013.01); *G10H 1/06* (2013.01); *G10H 1/08* (2013.01); *G10H 5/12* (2013.01)

(58) Field of Classification Search

CPC ..... G10H 7/002; G10H 1/0066; G10H 1/08; G10H 5/12; G10H 1/06

USPC ..... 84/622

See application file for complete search history.

(56) References Cited

U.S. PATENT DOCUMENTS

| | | | | |
|---|---|---|---|---|
| 4,036,096 | A | 7/1977 | Tomisawa et al. | |
| 4,246,823 | A | 1/1981 | Wachi et al. | |
| 4,249,447 | A | 2/1981 | Tomisawa | |
| 4,444,082 | A | 4/1984 | Whitefield | |
| 4,602,545 | A | 7/1986 | Starkey | |
| 4,658,369 | A | 4/1987 | Sugiura | |
| 4,719,833 | A | 1/1988 | Katoh et al. | |
| 4,875,400 | A | 10/1989 | Okuda et al. | |
| 5,029,120 | A | 7/1991 | Brodeur et al. | |
| 5,060,179 | A | 10/1991 | Sharp | |
| 5,221,803 | A * | 6/1993 | Izumisawa | G10H 1/08 84/653 |
| 5,252,773 | A | 10/1993 | Kozuki et al. | |
| 5,490,234 | A | 2/1996 | Narayan | |
| 5,604,323 | A | 2/1997 | Hardie-Bick | |

(Continued)

OTHER PUBLICATIONS

Search Report and Written Opinion for PCT/US2018/13028, dated Apr. 5, 2018, 8 pages.

*Primary Examiner* — Jeffrey Donels

(74) *Attorney, Agent, or Firm* — Skaar Ulbrich Macari, P.A.

(57) ABSTRACT

The present disclosure is directed to multi-source switched sequence oscillator waveform compositing system that allows for real-time modulation of a specific fraction of the cycle period within the output waveform, resulting in a greater and more dynamic number of waveform variations than simple assembly of various shapes.

4 Claims, 13 Drawing Sheets

(56) References Cited

U.S. PATENT DOCUMENTS

| | | | | |
|---|---|---|---|---|
| 5,701,393 | A * | 12/1997 | Smith, III | G10H 5/007 327/129 |
| 5,740,320 | A | 4/1998 | Itoh | |
| 6,175,821 | B1 | 1/2001 | Page et al. | |
| 6,304,846 | B1 | 10/2001 | George et al. | |
| 6,311,158 | B1 | 10/2001 | Laroche | |
| 6,366,883 | B1 | 4/2002 | Campbell et al. | |
| 6,476,990 | B1 | 11/2002 | Hansen | |
| 6,574,059 | B1 | 6/2003 | Hansen | |
| 6,957,239 | B2 | 10/2005 | Conway et al. | |
| 6,968,021 | B1 | 11/2005 | White et al. | |
| 6,974,902 | B2 * | 12/2005 | Adam | G10H 1/08 84/671 |
| 7,064,556 | B2 | 6/2006 | Petchenev et al. | |
| 7,158,763 | B2 | 1/2007 | Edmonson et al. | |
| 7,337,110 | B2 | 2/2008 | Jasiuk | |
| 7,483,608 | B2 | 1/2009 | Inoue et al. | |
| 7,487,092 | B2 | 2/2009 | Gleason et al. | |
| 7,773,028 | B2 | 8/2010 | Chan et al. | |
| 7,853,452 | B2 | 12/2010 | Gleason et al. | |
| 7,869,992 | B2 | 1/2011 | Raifel et al. | |
| 7,953,600 | B2 | 5/2011 | Hertz et al. | |
| 8,619,908 | B2 | 12/2013 | Hoffmann et al. | |
| 8,878,620 | B2 * | 11/2014 | Sauerwein | G06F 1/0321 331/172 |
| 9,120,280 | B2 | 9/2015 | Mawby et al. | |
| 9,460,707 | B1 | 10/2016 | Fridman-Mintz | |
| 9,747,892 | B1 | 8/2017 | Fridman-Mintz | |
| 2004/0216587 | A1 * | 11/2004 | Adam | G10H 1/08 84/659 |
| 2008/0005213 | A1 * | 1/2008 | Holtzman | G06F 1/0335 708/276 |

* cited by examiner

800

810

820

830

840

850

860

870

MULTI-SOURCE SWITCHED SEQUENCE OSCILLATOR WAVEFORM COMPOSITING SYSTEM

CLAIM OF BENEFIT TO PRIOR APPLICATION

This application claims the benefit of U.S. Provisional Application No. 62/444,270 filed Jan. 9, 2017; and such application is hereby fully incorporated by reference herein.

FIELD

The present invention relates generally to the field of sound and music synthesis, and more specifically to the oscillator section of a synthesizer.

BACKGROUND

Synthesizers use various methods to generate electronic signals. Among the most popular waveform synthesis techniques are subtractive synthesis, additive synthesis, wavetable synthesis, frequency modulation synthesis, phase distortion synthesis, physical modeling synthesis and sample-based synthesis. Other less common synthesis types include sub harmonic synthesis, a form of additive synthesis via sub harmonics, and granular synthesis. None of these waveform synthesis techniques provide phase coherent wave switching at audio rate.

Therefore, there is an unfulfilled need for a better way of controlling switching periods thus allowing for a greater and more dynamic number of waveform variations, better synchronous musical relationships between the switch and the source oscillators, and allowing for complex sounds and harmonics to be created.

SUMMARY

The present disclosure is directed to a digital audio system for generating a composite waveform from a switched sequence of multiple source oscillators. Precise phase and pitch control between the switch and source oscillators allows for a wide variety of complex, yet musically relevant, sonic results. This summary is not intended to limit the scope of the invention, or describe each embodiment, implementation, feature or advantage of the invention.

DETAILED DESCRIPTION OF THE PREFERRED EMBODIMENTS

Figure 1:
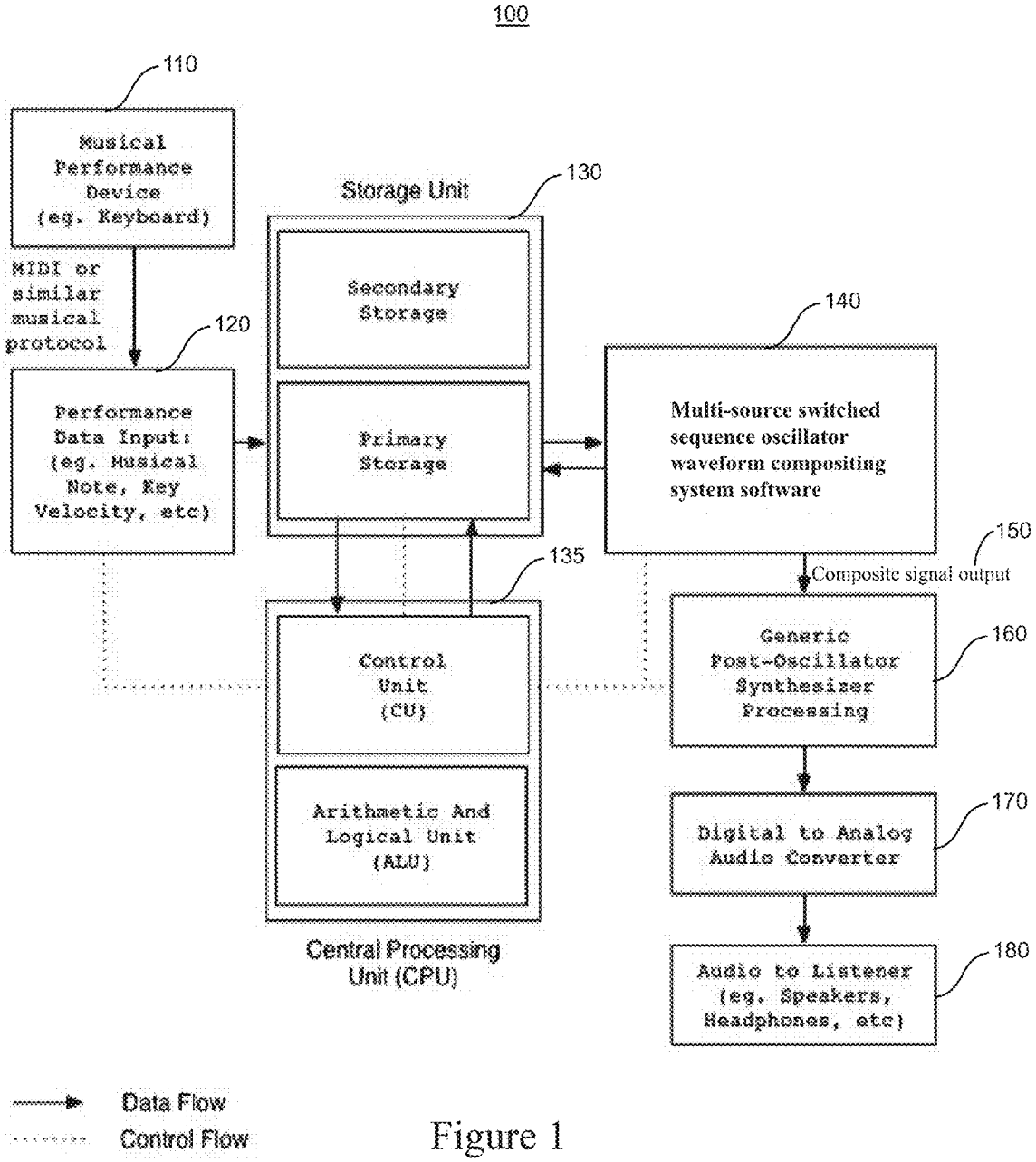
FIG. 1 is a system diagram of a preferred embodiment of the multi-source switched sequence oscillator waveform compositing system invention.

The present invention relates to the field of music synthesis, creating new and unique sonic possibilities, specifically for the oscillator section of a synthesizer design. Using multiple source oscillators routed into a common clocked switch, the oscillators and switch are tightly coupled in both phase and frequency. The clocking rate of the switch creates a composite output waveform that is made up of segments of input source waveforms, sequentially arranged in the output signal. The clock rate and the oscillator sources track pitch together so that the clocked switch is able to consistently choose a sequenced set of source oscillators for individual parts of the output waveform cycle. Source oscillators can be controlled both dependently and independently of the clocked switch. This allows for real-time modulation of a specific fraction of the cycle period within the output waveform, resulting in a greater and more dynamic number of waveform variations than simple assembly of various shapes. The ability to synchronize the phase of a source oscillator to the start of a cycle period, or to the start of a cycle segment, allows for complex harmonics to be created without changing the fundamental frequency of the output waveform.

The disclosed invention is comprised of multiple oscillator waveforms feeding a clocked switch with precise pitch and phase relationship between the source oscillations and the switch allowing for sample accurate switched waveform generation. The composite waveform output exhibits harmonic content that is a mixture of the harmonic content contained in each fractional waveform segment, in addition to the fundamental frequency and harmonics generated by the invention's switching system. Oscillator Source Switching can be used with any audio source to apply pitch to non-pitched sources, or to create a fundamental pitch across a variety of frequencies and levels contained in the fractional source waveforms.

Synchronization of source oscillators from a clocked switch allows for harmonic generating effects while maintaining a clear fundamental frequency in the output waveform. The waveform segment transitions create harmonics similar to square or pulse waves depending on the discontinuity between the waveform fragments on either side of the transition point. Transition smoothing is implemented to filter the harmonic content potentially generated by the transition.

Each wave transition, intrinsic to the invention, offers the opportunity to apply oscillator hard sync to the individual oscillator waveform fraction contained in the following segment. Multiple sync points within a single cycle and extending beyond a single cycle are possible, and have never been presented before in a single oscillator output waveform.

The invention produces a new form of amplitude modulation, which is applied to all non-contiguous harmonics in each wave segment. While capable of amplitude modulating the full audio signal, the invention also allows harmonic discontinuities to be created through manipulating source oscillator wave properties. This can result in more traditional AM output, but it may also generate an ordered amplitude sequence, depending on the content of the divisions. Repetition of the sequence cycle generates a fundamental frequency and harmonics dependent on the fractional wave content in the sequence. Input to the invention is not limited to oscillator waveforms, but can be any source signal.

FIG. 1 is a system diagram of a preferred embodiment of multi-Source switched sequence oscillator waveform compositing system 100. Musical performance device 110, or other device, sends a trigger-on event signal (e.g. note) to system 100 indicating the system is about to start processing. There is a trigger-off event between notes.

Performance data information 120 is extracted from the note trigger. This information will include velocity information and the base frequency or pitch of the note to determine how the oscillator output should sound. This information is passed to storage unit 130 where it is available to be processed by software 140 when software 140 executed by processor 135. Software 140 can be stored in any non-transitory computer-readable media including all computer-readable media, with the sole exception being a transitory, propagating signal.

Composite signal output 150 is then passed to post-oscillator synthesizer processing step 160. This processing may include envelope, filter and other effects. Finally the processed signals are passed to the digital to analog converter 170 and then to output device 180, which may include speakers, headphones and the like.

Figure 2:
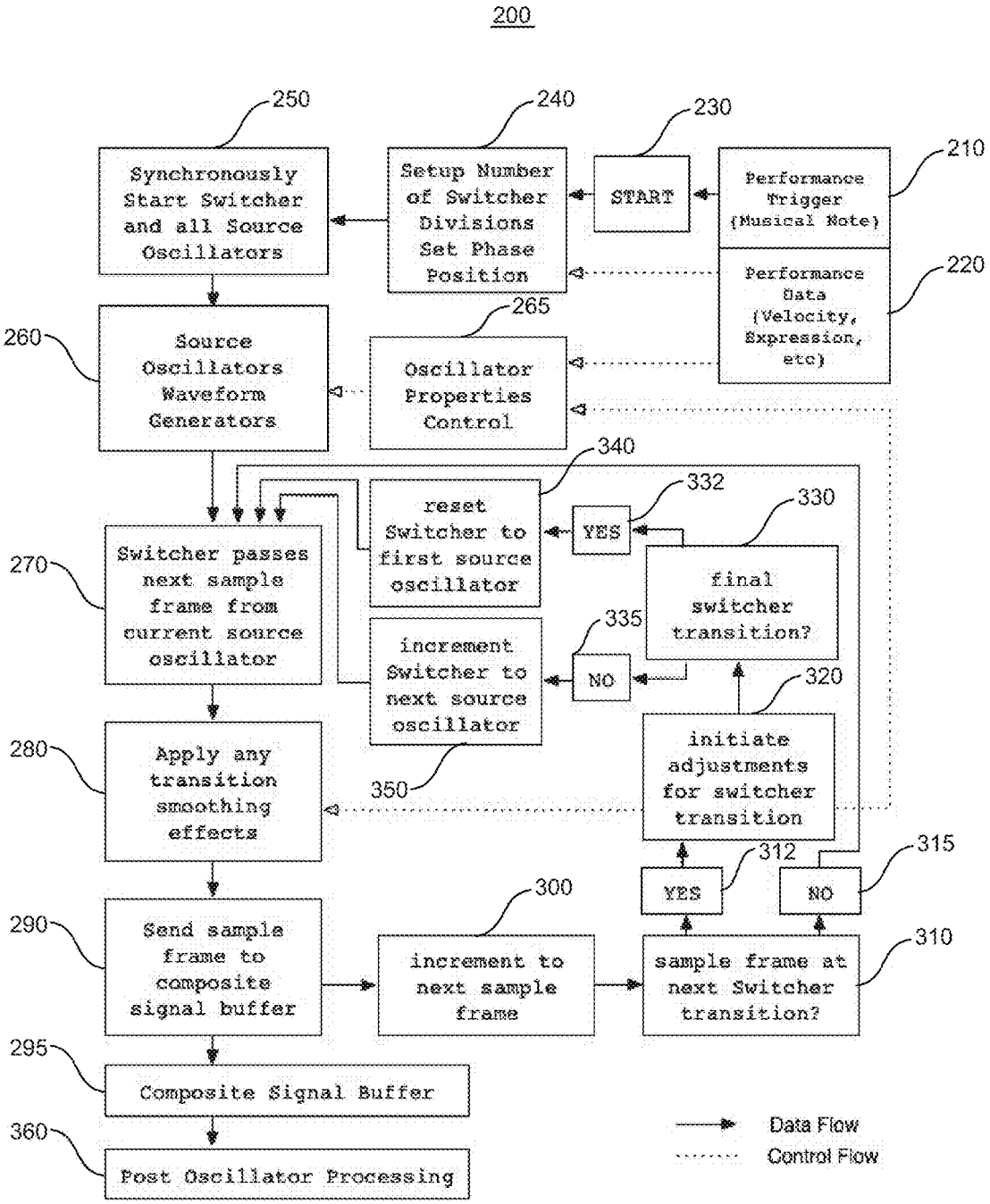
FIG. 2 is an algorithm representing the multi-source switched sequence oscillator waveform compositing system software.

FIG. 2 is a representation of algorithm 200, which is a preferred embodiment of the operation of the multi-source switched sequence oscillator waveform compositing system software 140. Algorithm 200 is triggered to begin at step 230 by the introduction of trigger-on signal (e.g. musical note) at step 210. Performance data is extracted at step 220 from trigger-on signal 210. A trigger-off signal is generated between notes to indicate the end of the note.

Setup at step 240 is user controlled wherein the number of switchers and phase positions are set. Step 265 is the stage where oscillator waveform properties that were originally chosen by the user, such as shape, relative phase, relative pitch, volume, dc offset, duty cycle, etc., are further adjusted based on the Performance data extracted at step 220. At step 250 the source oscillator waveforms are further adjusted to be synchronous with the switcher clock and then the switcher and all source oscillators are synchronously started. Thus with precise control of the waveform properties indicated at steps 250 and 265, the composite signal output 150 (FIG. 1) is pitch and phase coherent.

At Step 260 the source oscillator wave forms are generated and at step 270 a sample frame is taken from the currently accessed source oscillator and passed to step 280. At step 280 an amplitude or filter transformation may be applied over successive frames in order to smooth the transition between waveforms.

At step 290 the processed sample frame is then passed to the composite signal buffer at step 295, and the next sample frame is considered at step 300. If the sample frame position for the next switcher transition has been reached, then YES 312 path is selected and the process moves to step 320. If the sample frame for the next switcher transition has not been reached, then NO 315 path is selected and the process returns to step 270 where the next sample frame from the same source oscillator is passed from the switcher. The process then runs through steps 280-300 as previously described.

If step YES 312 has been reached, then the process proceeds to step 320 where control signals are sent to the amplitude adjustment process 280, where transition effects may be applied to smoothly transition to the next segment. For example, when switching from one oscillator to the next, it may be desirous to initiate a smooth ramp transition effect to the next source oscillator's amplitude level, instead of hard switching to that level. Step 320 also sends a control signal to the source oscillators' properties controller Step 265 where any adjustments, such as hard sync/reset of a source oscillator, can be made at the time the switcher transitions.

The process proceeds to step 330 where it is determined whether the sample frame position for the final switcher transition has been reached. If YES 332, the switcher is reset to the first source oscillator. If NO 335, the switcher is incremented to the next source oscillator. After the process is reset at step 340 or incremented at step 350, the process proceeds to step 270 and the 270-300 loop is repeated. The process terminates when the system is no longer needed, either because the musical note performance has been released (trigger-off), or at some length of time beyond that point if a fade-out duration is applied (typically, through applying an amplitude envelope modulation with a long release time). Subsequent to step 295 the processed signals are passed to step 360 for post oscillator processing.

Figure 3:
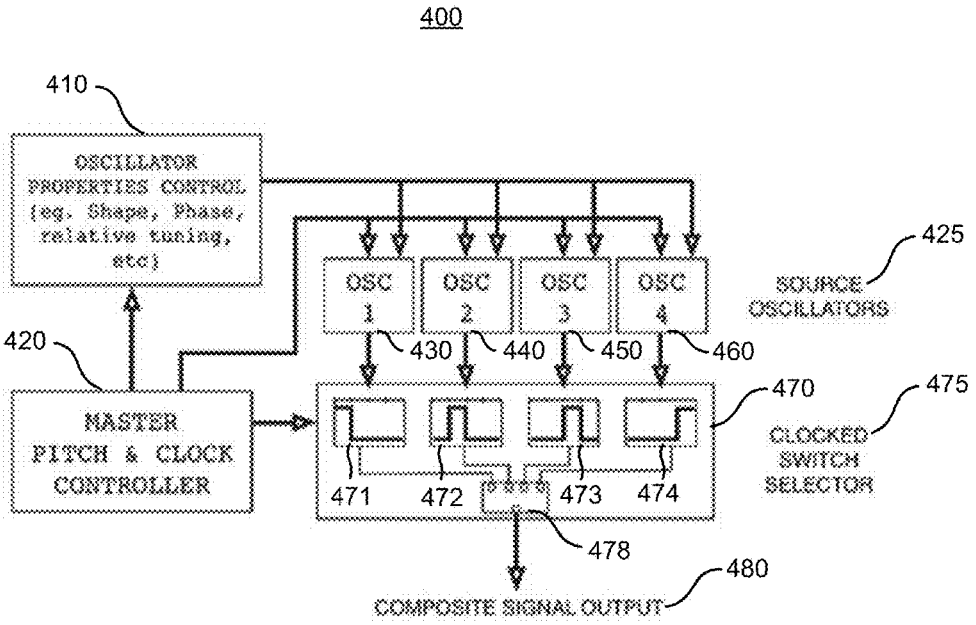
FIG. 3 is a diagram depicting an exemplary four source oscillator configuration switched at ¼ cycle intervals.

FIG. 3 is a diagram depicting an exemplary four source oscillator configuration 400 switched at ¼ cycle intervals. The exemplary four source oscillator configuration 400 comprises Oscillator Properties Controller 410, Master Pitch and Clock Controller 420, Source Oscillators 425, Clocked Switch Selector 475 and multiplexer 478. The source oscillators in this example consist of four oscillators 430, 440, 450 and 460. Each source oscillator has a corresponding switcher division 471, 472, 473 and 474. Oscillator 430 corresponds to clocked switcher division 471 and so on.

Master Pitch and Clock Controller 420, based on the pitch determined by the trigger note, chooses a reference clock frequency to drive the switcher and maintain phase and pitch coherence with the source oscillators. Oscillator Properties Controller 410 receives master clock and pitch information from the Master Pitch and Clock Controller 420. The four source oscillators 430, 440, 450 and 460 and the selection switcher 478 are synchronously clocked to create a ¼ cycle switched composite signal output when passed out of multiplexer 478. It should be appreciated that this synchronization allows for the adjustment of oscillator properties while the output will continue to supply pitch and phase coherent composite waveforms. For example if the relative phase of the source oscillator is changed, the pitch will remain locked but the section of the source oscillator's waveform that is fed to the switcher will be in a different phase relative to the rest of the source oscillators, resulting in a drastically different harmonic structure in the composited output waveform. Another example is that if the relative tuning of a source oscillator was changed to plus 1 octave, for example, the master pitch clock will keep the oscillator in phase, but will generate a very different waveform creating unique harmonics. The results in these cases would still be pitch and phase coherent, but the harmonic structure would be very different.

It should be noted that the compositor is not limited to four input sources, but can switch between any numbers of sources and waveform fractions.

Figure 4:
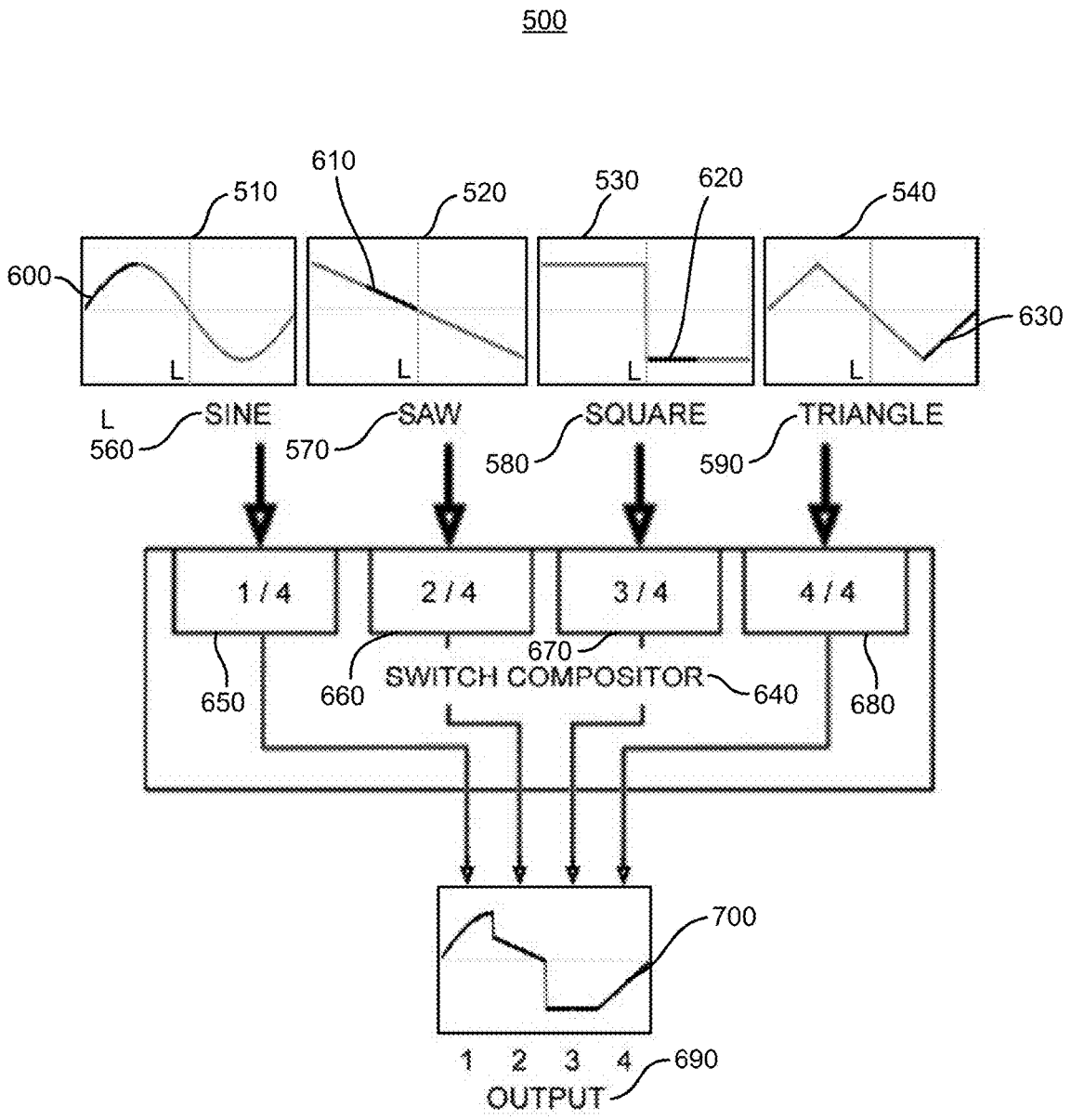
FIG. 4 depicts the operational flow of the wave switching compositor showing specific waveform input versus output.

FIG. 4 represents an example of the creation of a phase coherent concatenated waveform at audio rate using a four source oscillator configuration 500. Configuration 500 comprises four source oscillators: 510, 520, 530 and 540. Oscillator 510 is sourced with sinewave 560, oscillator 520 is sourced with saw wave 570, oscillator 530 is sourced with square wave 580 and oscillator 540 is sourced with triangle wave 590. The sample frames are taken from each waveform in the lighter areas indicated in each waveform. For sine wave 560 the sample frames are taken from area 600, for saw wave 570 the sample frames are taken from area 610, the sample frames for square wave 580 are taken from area 620 and the sample frames from triangle wave 590 are taken from area 630. The oscillators are synchronized with the master pitch clock (see FIG. 3). The waveform divisions are processed by the invention in ¼ cycle slices by clocked switched compositor 640. Switched compositor 640 is comprised of four switcher divisions 650, 660, 670 and 680. The Sequenced or Composite Signal Output 690 is output waveform 700. Note that the sampled areas of each source oscillator's waveform are concatenated, and have uniform boundaries to create a uniform, multi-shaped waveform.

Figure 5:
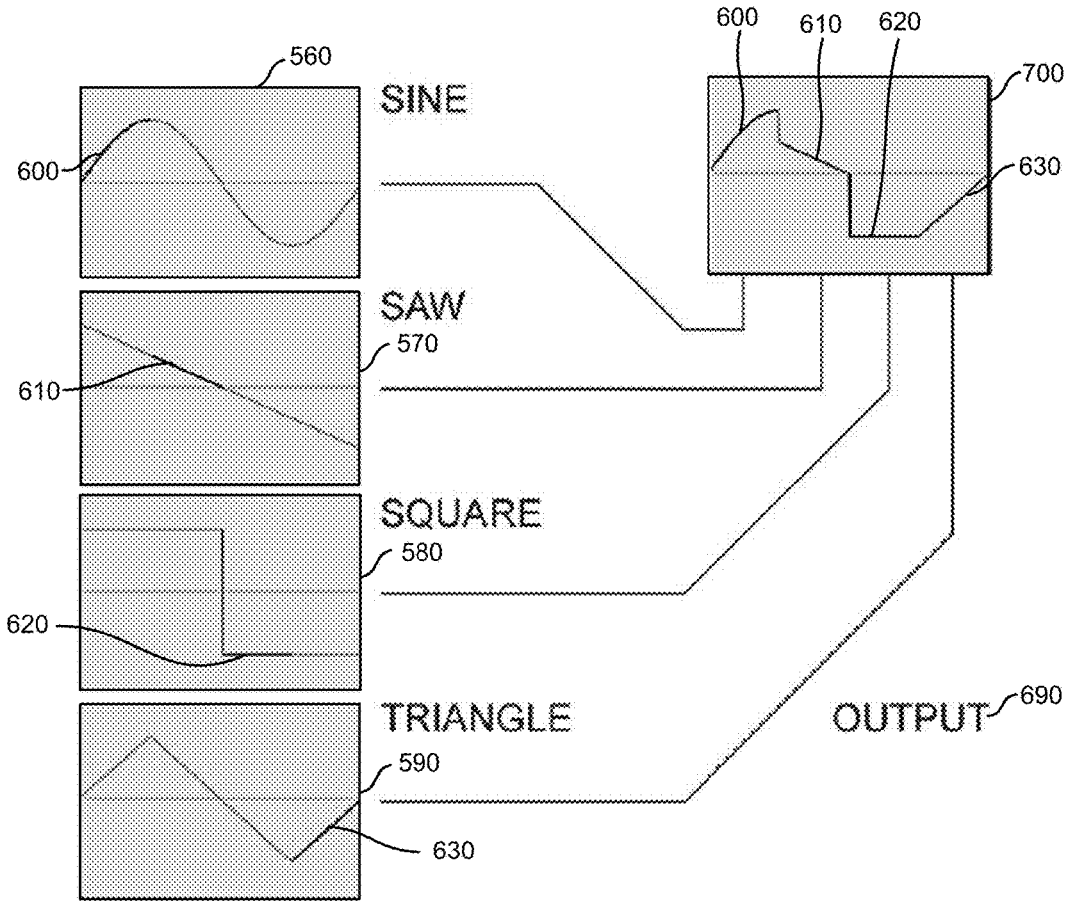
FIG. 5 demonstrates the relationship between the input waveform samples and the resultant sequenced signal output.

FIG. 5 depicts in detail how the resultant output waveform 700 is made up of concatenated segments of the source oscillator's waveforms.

Figure 6:
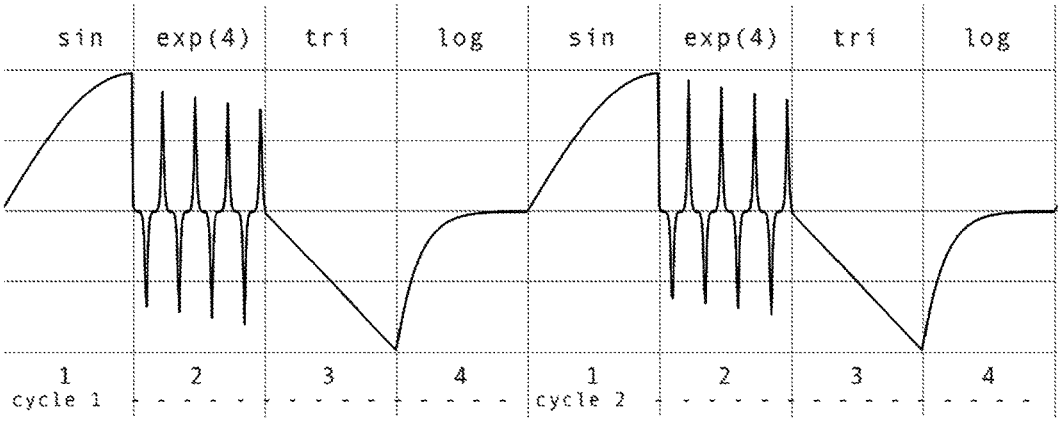
FIG. 6 is an output waveform demonstrating independent frequency per sequenced wave segment cycle.

FIG. 6 depicts output waveform 800 that illustrates an independent frequency setting for a single segment's source oscillator. This configuration utilizes four source oscillators with ¼ cycle switched composite signal output. The waveform in segment 2 set to a harmonically relative higher frequency than the main fundamental frequency of the switch and other source oscillators. In this configuration, segment 2 generates new harmonics related to its own waveform frequency content and any segment edge discontinuities generated with adjacent segments. This is a unique waveform that allows for a specific segment of the cycle to have its pitch modified, yet remain in a perfect phase relationship with the overall wave cycle.

Figure 7:
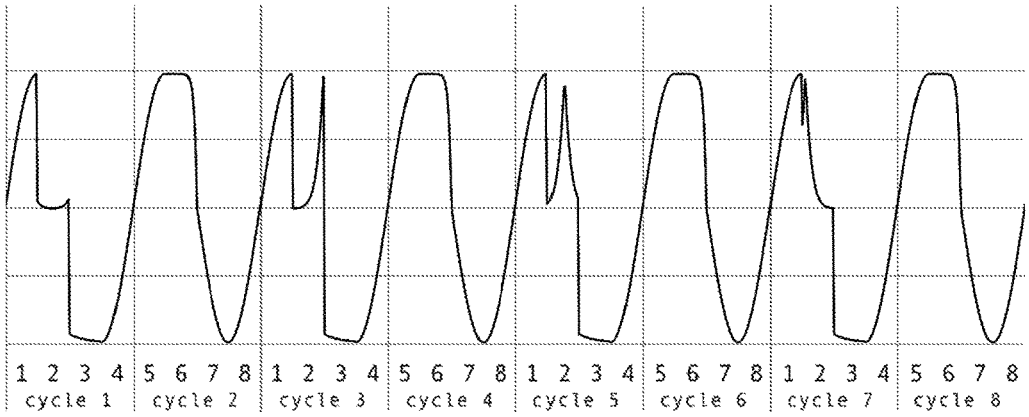
FIG. 7 is an output waveform demonstrating waveform phase manipulation beyond a single cycle segment.

In FIG. 7, segment 2 of 8 of waveform 810 shows phase movement asynchronous to the switching frequency, demonstrating the creation of waveform differences beyond a single cycle. The result of this configuration contributes harmonic content to the concatenated waveform from the actual waveform frequency content of segment 2, harmonics generated from waveform discontinuities, and those of a bi-cyclical wave event one octave down from the fundamental, including all the harmonics so produced. Because the waveform in segment 2 is asynchronous, the resultant harmonic content is always in motion, shifting in conjunction with the phase relationships between the waveform in segment 2 and the switcher frequency. This is a unique waveform that allows for a specific segment of the cycle to have its pitch modified and move freely within a single specific segment of an overall waveform that it otherwise phase coherent, creating a complex and unique modulating harmonic result.

Figure 8:
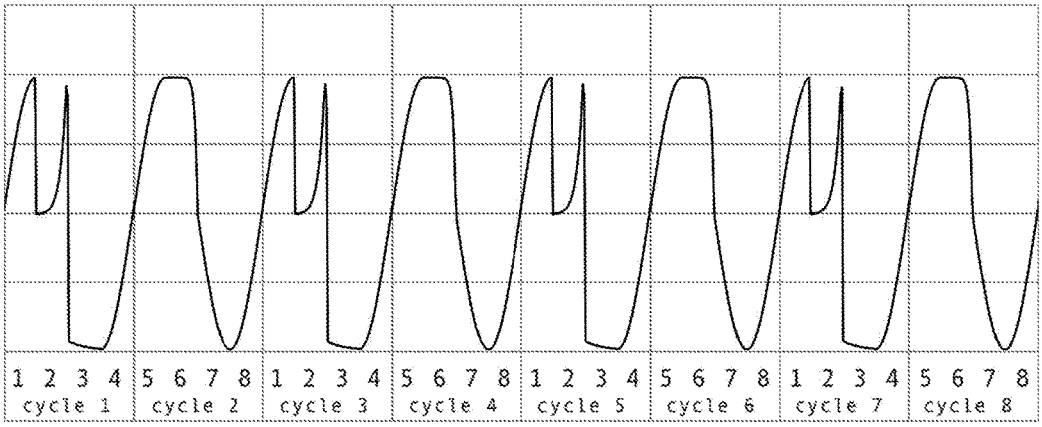
FIG. 8 is an output waveform demonstrating a bi-cycle waveform hard sync only in a single segment (e.g. segment 2) within two cycles.

In FIG. 8, segment 2 of 8 of waveform 820 depicts a hard sync phase reset for an individual segment, demonstrating a waveform hard sync beyond a single cycle. The result of this configuration contributes harmonic content to the concatenated waveform both from the actual segment waveform frequency content, harmonics generated from waveform discontinuities, and that of a bi-cyclical wave event one octave down from the fundamental, including all the harmonics so produced. This is a unique waveform that allows for a specific segment of the cycle to have its pitch modified and yet still remain locked in a constant phase relationship within the wave cycle, creating a complex and unique consistent harmonic result.

Figure 9:
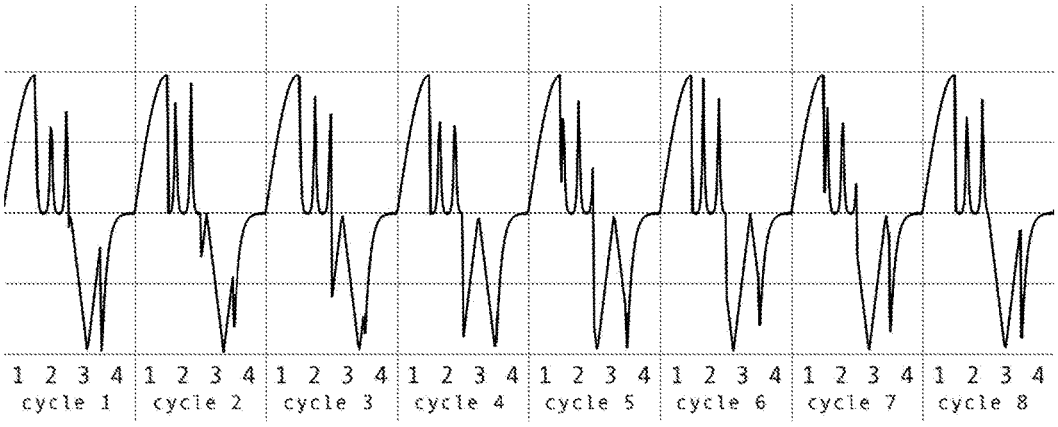
FIG. 9 is an output waveform demonstrating a waveform phase manipulation in more than one segment (e.g. segments 2 and 3) within a cycle.

In FIG. 9, segments 2 and 3 (of 4) of waveform 830 depict phase movements asynchronous to the switching frequency, exemplifying multiple independent segment phase movements within a single cycle. The result of this configuration contributes harmonic content to the concatenated waveform both from the actual waveform frequency content of the segments and the harmonics generated from multiple waveform discontinuities. Because the waveforms in segments 2 and 3 are asynchronous, the resultant harmonic content is always in motion, shifting in conjunction with the phase relationships between the waveforms in segments 2 and 3 and the switcher frequency. This is a unique waveform that allows for specific segments of the cycle to have pitch modification and move freely within their respective specific segments of an overall waveform that it otherwise phase coherent, creating a complex and unique modulating harmonic result.

Figure 10:
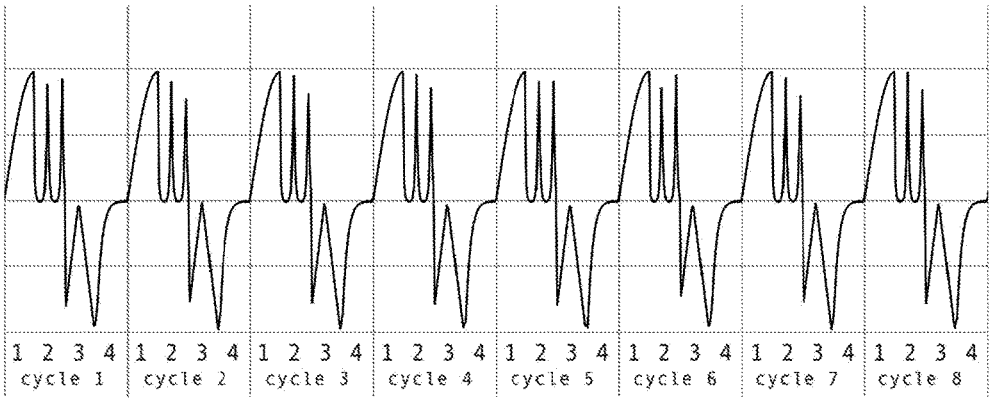
FIG. 10 is an output waveform demonstrating multiple hard sync reset points (e.g. segments 2 and 3) within a cycle.

FIG. 10 depicts multiple hard sync points within a cycle in waveform 840. Segments 2 and 3 (of 4) show a hard sync phase reset for multiple individual segments, demonstrating a waveform hard sync at multiple points within a single cycle. The result of this configuration contributes harmonic content to the concatenated waveform both from the actual frequency content of the segment waveforms and the harmonics generated from multiple waveform discontinuities. This is a unique waveform that allows for specific segments of the cycle to have pitch and phase modifications and yet still remain locked in a constant phase relationship within the wave cycle, creating a complex and unique consistent harmonic result.

Figure 11:
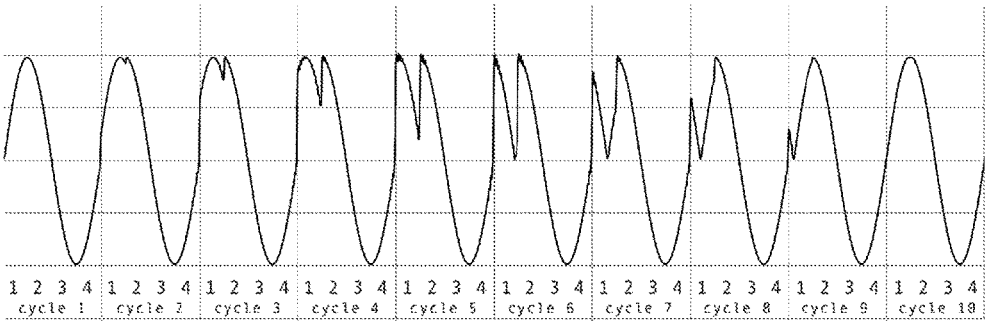
FIG. 11 is an output waveform demonstrating phase movement asynchronous from the switching frequency.

FIG. 11 depicts output waveform 850 demonstrating an asynchronous phase movement per segment. Segment 1 of 4 shows phase movement asynchronous from the switching frequency. The result of this configuration contributes harmonic content to the concatenated waveform both from the actual waveform frequency content of the segment, and the harmonics generated from waveform discontinuities with adjacent segments. Because the waveform in segment 1 is asynchronous, the resultant harmonic content is always in motion, shifting in conjunction with the phase relationships between the waveform in segment 1 and the switcher frequency. This is a unique waveform that allows for a specific segment of the cycle to have its pitch modified and move freely within a single specific segment of an overall waveform that it otherwise phase coherent, creating a complex and unique modulating harmonic result.

Figure 12:
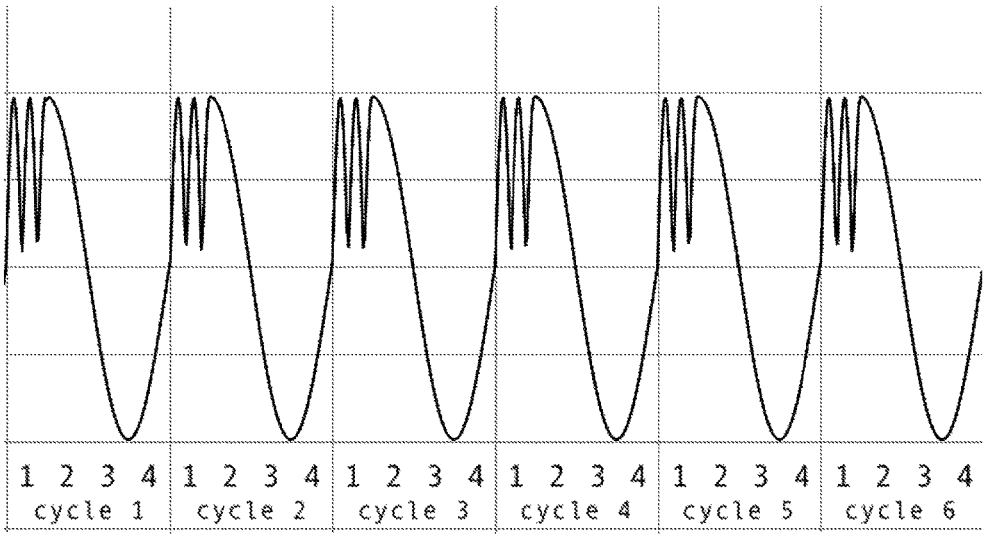
FIG. 12 is an output waveform demonstrating a hard sync reset for segment 1.

FIG. 12 depicts waveform 860 hard sync per segment. Segment 1 of 4 demonstrates the resultant hard sync phase reset for an individual segment. This configuration contributes harmonic content to the concatenated waveform from both the actual waveform frequency content of segment 1 and the harmonics generated from waveform discontinuities with adjacent segments. This is a unique waveform that allows for a specific segment of the cycle to have its pitch and phase modified, yet remains in a perfect phase relationship with the overall wave cycle.

Figure 13:
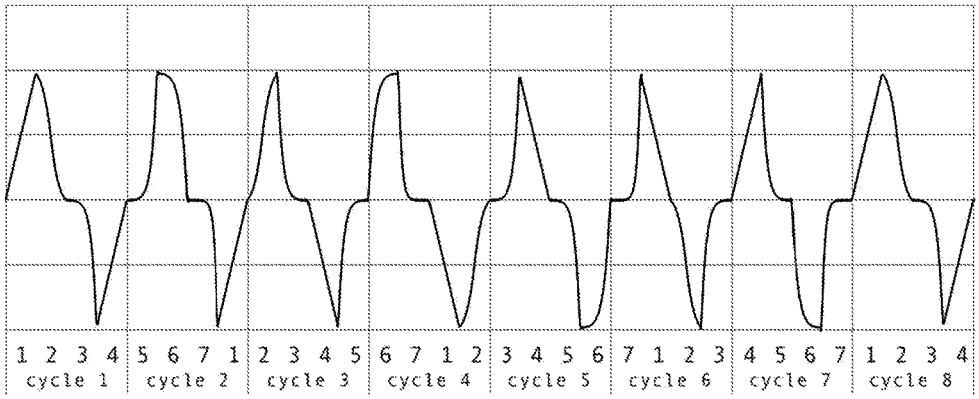
FIG. 13 is an output waveform demonstrating a fractional relationship between segment repetitions and sequencing frequency.

FIG. 13 depicts output waveform 870 demonstrating the fractional relationship between segment repetitions and sequencing frequency. This figure depicts a composite waveform consisting of seven segments, all with different waveform content, and with the segment lengths set to ¼ cycle. The resultant waveform in this 7/4 fractional relationship is a waveform shape that repeats only every 28 segments, or every 7 full cycles. When the numerator (number of segments) is not an integer multiple or division of the denominator (divisions of a cycle), the resulting harmonic output tends to sound inharmonic or dissonant in relation to the fundamental. This is a unique waveform combination that generates harmonics at, above, and below the fundamental frequency that would not exist without the fractional nature of this switcher configuration.

The disclosed invention may also be used as a low frequency oscillator modulation source. A LFO is generally not audible itself, but can still be used to affect audio, as when a sine LFO is applied to an oscillator's pitch parameter in order to create vibrato or to a sound's amplitude to create tremolo. The disclosed invention may also be applied to a filter or an effect in order to change the sound's timbre. The invention may also be employed to scan through a table of values in order to create a non-linear sequence, which can in turn be used as a modulator for any audible parameter of sound. The invention's composite output allows for more intricate and dynamic modulation of sound, with a character unique to the invention.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. For purposes of interpreting the claims for the present invention, it is expressly intended that the provisions of Section 112, paragraph (f) of 35 U.S.C. are not to be invoked unless the specific terms "means for" or "step for" are recited in a claim.

We claim:

1. A non-transitory computer-readable medium having instructions stored thereon that, when executed by a processor, cause the processor to generate a phase coherent concatenated waveform at audio rate from a switched sequence of multiple source oscillators, the generation comprising:

receiving performance data;

setting a switch compositor with at least two switcher divisions;

setting phase positions for each switcher division;

setting a number of source oscillators corresponding to the number of switcher divisions;

setting frequency and phase properties for each source oscillator and the switch compositor based on performance data input;

starting a master pitch clock that is synchronized with both the source oscillators and the switch compositor at a rate, based upon the performance data input, that maintains phase and pitch coherence with the source oscillators;

selecting sample frames from each source oscillator;

traversing each respective switcher division at the rate set by the master pitch clock;

maintaining constant pitch and phase coherence of the source oscillators; and, outputting a phase coherent concatenated waveform.

2. A system for generating a phase coherent concatenated waveform from a switched sequence of multiple source oscillators, the system comprising:

a memory configured to store a multi-source switched sequence oscillator waveform compositing software;

a processor configured to execute the multi-source switched sequence oscillator waveform compositing software stored on the memory;

wherein the multi-source switched sequence oscillator waveform compositing software is configured to receive performance data input;

wherein the multi-source switched sequence oscillator waveform compositing software is further configured to set a switch compositor with at least two switcher divisions;

wherein the multi-source switched sequence oscillator waveform compositing software is further configured to set phase positions for each switcher division;

wherein the multi-source switched sequence oscillator waveform compositing software is further configured to set a number of source oscillators corresponding to the number of switcher divisions;

wherein the multi-source switched sequence oscillator waveform compositing software is further configured to set frequency and phase properties for each source oscillator and the switch compositor based on performance data input;

wherein the multi-source switched sequence oscillator waveform compositing software is further configured to start a master pitch clock that is synchronized with both the source oscillators and the switch compositor at a rate, based upon the performance data input, that maintains phase and pitch coherence with the source oscillators;

wherein the multi-source switched sequence oscillator waveform compositing software is further configured to select sample frames from each source oscillator;

wherein the multi-source switched sequence oscillator waveform compositing software is further configured to traverse each respective switcher division at the rate set by the master pitch clock;

wherein the multi-source switched sequence oscillator waveform compositing software is further configured to maintain a constant pitch and phase coherence of the source oscillators; and, wherein the multi-source switched sequence oscillator waveform compositing software is further configured to output a phase coherent concatenated waveform.

3. A method for generating a phase coherent concatenated waveform, the generation comprising:

receiving performance data;

setting properties of at least two source oscillators;

setting a number of switcher divisions corresponding to the number of source oscillators;

synchronously clocking the oscillators and switcher rate such that they are coupled in both phase and frequency;

selecting sample frames from the source oscillators; and, outputting a phase coherent concatenated waveform.

4. The method of claim 3 wherein the frequency is less than 20 Hz.

* * * * *